US005379858A

United States Patent [19]

Sandoval

[11] Patent Number: 5,379,858

[45] Date of Patent: Jan. 10, 1995

[54] COMPACT EMERGENCY DESCENDER SYSTEM

[76] Inventor: Alfredo R. Sandoval, Casilla 303, Tacna, Peru

[21] Appl. No.: 123,786

[22] Filed: Sep. 20, 1993

[51] Int. Cl.[6] ..... A62B 1/20

[52] U.S. Cl. ..... 182/7; 182/193

[58] Field of Search ..... 182/3–7, 182/191–193; 188/65.2–65.5

[56] References Cited

U.S. PATENT DOCUMENTS

| | | | |
|---|---|---|---|
| 221,332 | 11/1879 | Mankin | 188/65.5 |
| 288,411 | 11/1883 | Connolly | 182/7 |
| 556,099 | 3/1896 | Kingsbury | 188/65.5 |
| 586,173 | 7/1897 | Frahm | 182/193 |
| 666,879 | 1/1901 | White | 182/193 |
| 1,087,440 | 2/1914 | Freed | 188/65.5 X |
| 1,098,223 | 5/1914 | Brown | 182/193 |
| 3,799,287 | 3/1974 | Ledner | 182/5 |
| 3,834,489 | 9/1974 | Rabelos | 182/5 |
| 4,145,027 | 3/1979 | Brimo | 254/156 |
| 4,223,761 | 9/1980 | Sonnberger | 182/5 |
| 4,778,030 | 10/1988 | Blair | 182/5 |
| 5,107,956 | 4/1992 | Constantinis | 182/5 |

*Primary Examiner*—Alvin C. Chin-Shue

*Attorney, Agent, or Firm*—Cahill, Sutton & Thomas

[57] ABSTRACT

A descender system includes an elongated strap of sufficient length to lower a person from a danger area to a safe area. The descender system includes a harness adapted to support a person connected to a compact descender mechanism having a channel through which the strap passes. First, second and third parallel cylindrical pins supported in side-by-side alignment in the channel, the strap passing through a first end of the passage around portions of the first, second, and third pins and through a second end of the passage. The first pin is held stationary, allowing movement of the second and third pins toward the first pin. A camming surface adjustment moves a camming surface in sliding, leveraged engagement with the third pin to force it toward the second pin, incrementing frictional drag of the first, second, and third pins on the strap.

14 Claims, 2 Drawing Sheets

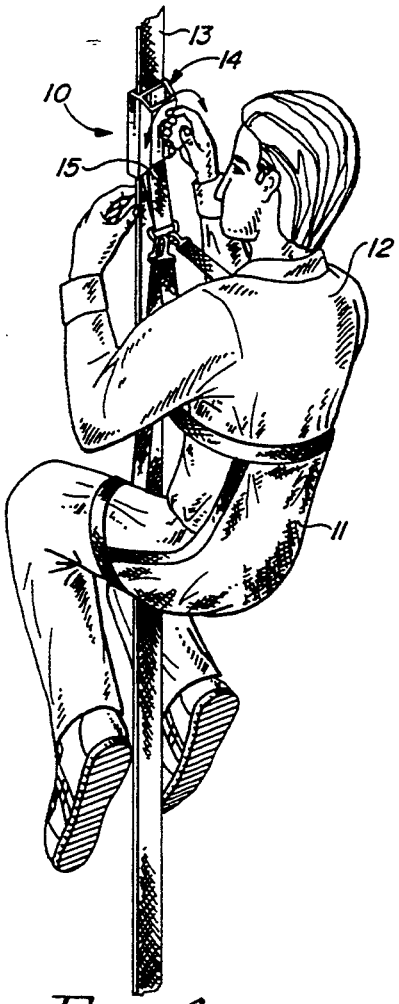
FIG. 1
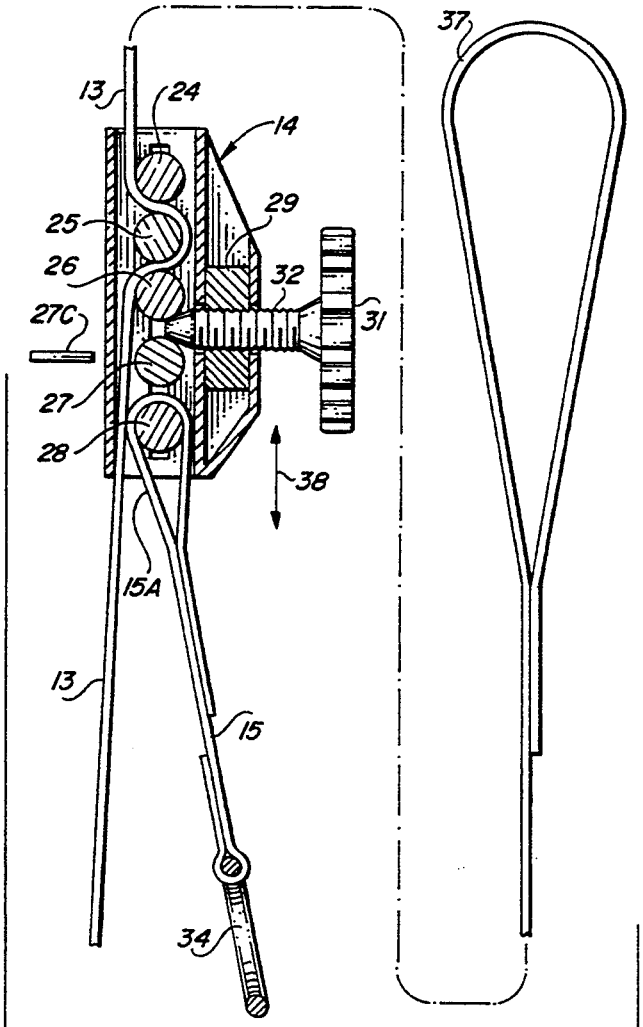
FIG. 5
FIG. 4
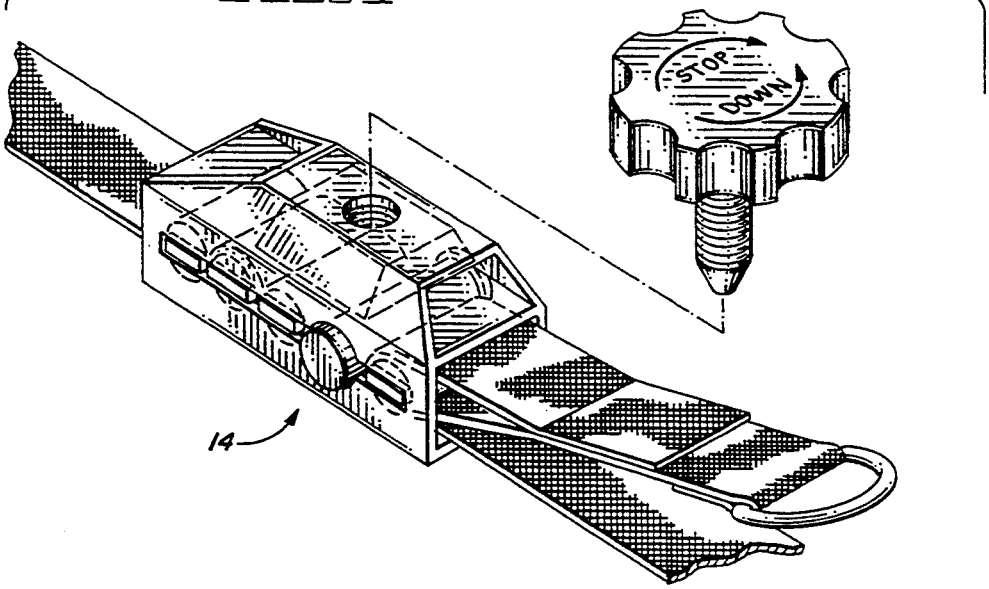

COMPACT EMERGENCY DESCENDER SYSTEM

BACKGROUND OF THE INVENTION

The invention relates to a portable escape or descender device that enables persons trapped in the interior of a building or other enclosure to safely descend therefrom. Many people have been injured or killed as a result of being trapped by fire in an upper floor of a tall building. Although multilevel buildings such as hotels usually are equipped with permanent fire escape stairways, access to such fire escape stairways is sometimes blocked by fire. In recognition of this problem, numerous portable descender devices have been devised. In U.S. Pat. No. 666, 879, a descender that utilizes a cable wound around a rotatable drum and operates in engagement with a rotatable brake drum is disclosed in U.S. Pat. No. 666,879. In U.S. Pat. No. 4,145,027, a cable weaves around a plurality of rotating pulleys and a rotary brake pulley with brake lining washers. In U.S. Pat. No. 1,098,223, the cable is engaged by a mechanism including a rotating brake drum, guide wheels, gears, pinions and a brake strap and friction plate operation by a lever. The device disclosed in U.S. Pat. No. 4,223,761 includes a rope or cable and rotating rollers and brake shoes, levers, cables and springs. U.S. Pat. No. 3,799,287 utilizes webbing or rope as an escape cord, and discloses a very complex mechanical structure. U.S. Pat. No. 3,834,489 utilizes rope in a structure that crimps the rope into an oval shaped configuration. U.S. Pat. No. 4,778,,030 applies pressure to, a rope escape line by an adjustable brake pad applied to the straight section of the rope as it passes through the device.

None of the above descender devices is sufficiently compact, inexpensive, and reliable to meet the need for a compact descender that travelers can easily carry in their suitcases and confidently utilize for escape in the event of a fire.

SUMMARY OF THE INVENTION

Accordingly, it is an object of the invention to provide an inexpensive, compact, lightweight emergency descender system which can be easily carried by ordinary travelers, without occupying an excessive amount of luggage volume.

It is another object of the invention to provide a compact emergency descender device which is much more simple in construction than most of the devices of the prior art.

It is another object of the invention to provide an emergency compact descender device that provides smooth, easily adjustable operation by a person supported thereby to allow the person to control the speed of descent, stop the descent if desired, or continue the descent.

It is another object of the invention to provide an emergency compact descender device capable of smooth, easy control of the rate of descent while supporting relatively large weights, for example, the weight of several adults.

Briefly described, and in accordance with one embodiment thereof, the invention providers a descender system including an elongated strap of sufficient length to lower a person from a danger area to a safe area, wherein an upper end portion of the strap is adapted for attachment to a stationary object, a harness is adapted to support a person being lowered. A compact descender mechanism includes a channel through which the strap passes. The compact descender mechanism includes a connecting element securely connecting the harness to the compact descender mechanism. First, second and third parallel cylindrical pins are supported in side-by-side alignment in the channel, the strap passing through a first end of the channel around a portion of the first pin and between it and the second pin, around a portion of the second pin and between it and the third pin, around a portion of the third pin, and through a second end of the passage. A support structure holds the first pin stationary in the compact descender mechanism, and allows movement of the second and third pins toward and away from the first pin. A camming surface engages a portion of the cylindrical surface of the third pin opposite from the second pin. A camming surface adjustment element is adapted to move the camming surface in sliding, leveraged engagement with the third pin to force it toward or move it away from the second pin, increasing the frictional drag of the first, second, and third pins on the strap. A manual control element is connected in leveraged relationship to the camming surface adjustment element, to allow the person to adjust the speed of descent. In the described embodiment, the camming surface adjustment element includes a threaded shaft perpendicular to a plane in which the first, second and third pins lie, and engages a threaded hole in a body of the compact descender mechanism. The camming surface is on a tapered end portion of the shaft. A fourth pin is disposed adjacent to the third pin and is attached in fixed relationship to the compact descender mechanism. The tapered end of the shaft extends between and engages the cylindrical surfaces of the third and fourth pins. A movable nut block includes the threaded hole through which the threaded shaft extends. The fourth pin bears against the tapered end as it is advanced between the third and fourth pins. The nut block moves parallel to the plane according to the amount the tapered end is advanced between the third and fourth pins. The manual control element includes a handle on an end of the threaded shaft opposite to the tapered end. The harness includes a seat web and a plurality of chords each connected at one end to the seat web and connected at an opposite end to a lower end of the harness support strap.

BRIEF DESCRIPTION OF THE DRAWINGS

FIG. 1 is a diagram illustrating the compact descender system of the present invention and use thereof.

FIG. 4 is a partial cutaway view illustrating the device shown in FIG. 3 in assembled form.

FIG. 5 is a section view illustrating the configuration of the device shown in FIGS. 3 and 4 during operation.

DETAILED DESCRIPTION OF THE PREFERRED EMBODIMENTS

Figure 3:
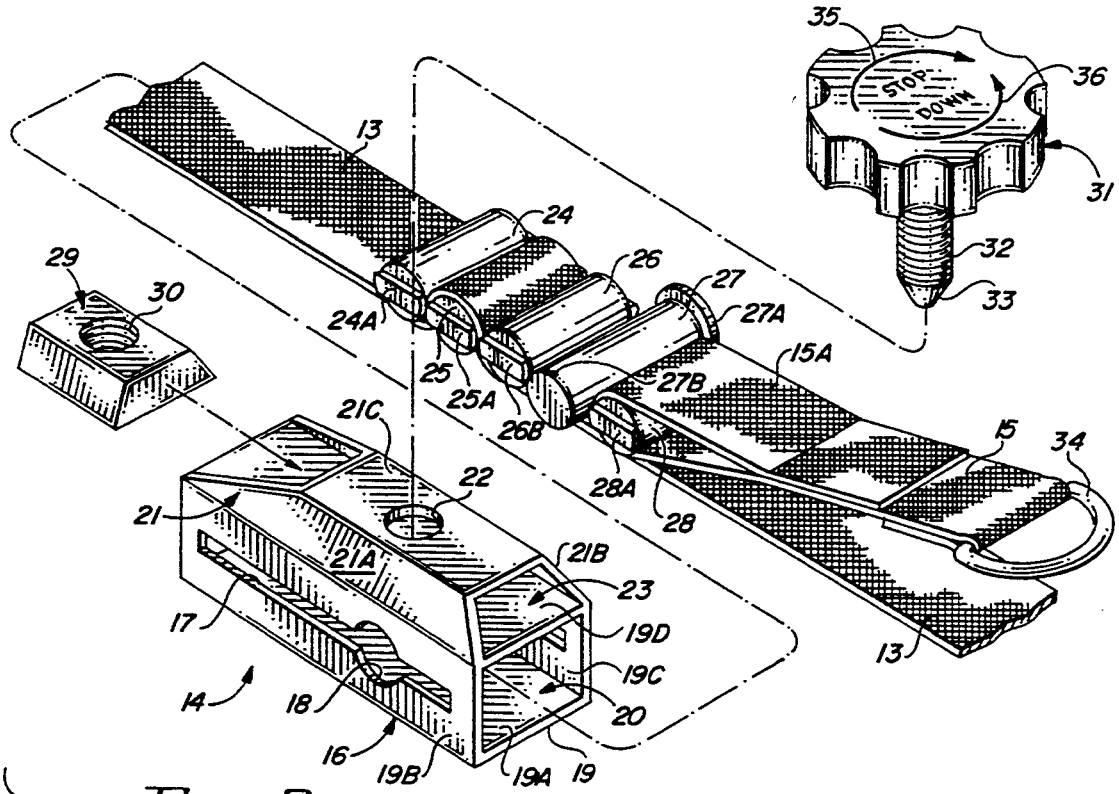
FIG. 3 is an exploded perspective view illustrating the components of a descender mechanism of the descender system shown in FIG. 1.

Referring now to the drawings, descender system 10 includes a descender mechanism 14, shown in detail in FIGS. 3–5, a body harness 11, a long webbing strap 13 passing through descender mechanism 14, and a harness support webbing strap 15. By rotating a control knob 31 on descender mechanism 14, the person 12 supported in harness 11 can slow down or stop the descent. Rotating control handle 31 clockwise decreases the rate of descent, and rotating it counterclockwise increases the rate of descent.

Figure 2:
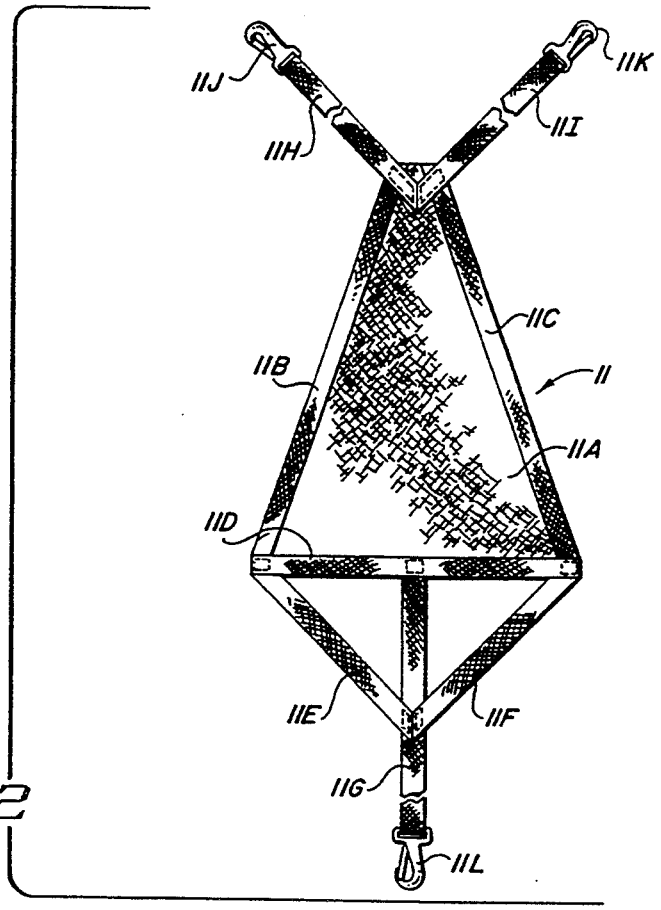
FIG. 2 is a plan view of the harness used in the descender system of FIG. 1.

Referring to FIG. 2, body harness 11 contains a fabric web or seating section 11A with peripheral reinforced sections of 11B, 11C, and lid attached thereto. Three main straps 11G, 11H, and 11I are attached to the seat section, having snap connector 11J, 11K, and 11L attached to their respective outer ends. A pair of straps 11E and 11F are connected between the lower corners of the generally triangular seat configuration shown in FIG. 2 and a mid portion of the front strap 11G. Straps 11H and 11I are connected to the apex of the triangular seat section as shown in FIG. 2.

Descender mechanism 14 includes a housing 16 formed of suitable steel or hardened aluminum. A lower channel 20 extends through housing 16. Channel 20 is bounded by opposed side walls 19B and 19C, each having an elongated slot 17 interrupted by a circular hole 18. The bottom of channel 20 is bounded by bottom 19A, and the top of channel 20 is bounded by panel 19D. A nut block retaining channel 23 is bounded by side walls 21A and 21B which are connected by a top 21C having a hole 22 therein. Moveable nut block 29 has a threaded hole 30 therein for receiving pressure screw 32. Threaded hole 30 is aligned with hole 22 when pressure screw 32 is installed as shown in FIG. 4.

Descender mechanism 14 is "installed" by passing strap 13 through channel 20, and then inserting cylindrical pin 24 into hole 18. Rectangular bosses 24A on opposite ends of pin 24 are then slid to the left from hole 18 in slot 17 above webbing strap 13. Then, identical cylindrical pin 25 is inserted beneath strap 13 through hole 18, and slid to the left in slot 17 toward pin 24. Next, a third identical pin 26 is inserted through hole 18 and its rectangular end bosses 26B are slid in slot 17 toward pin 25, providing the configuration of pins 24, 25, and 26 and strap 13 shown in FIG. 5.

Next, harness support pin 28, which is identical to the above-mentioned pins, is inserted through hole 18 after the loop 15A is aligned with hole 18. The rectangular bosses 28A are then slid to the left in slot 17, resulting in the configuration shown in FIG. 5 for harness strap pin 28 and harness support strap 15. Harness support strap 15 has a harness ring 34 attached to its lower end.

Next, pressure screw backup pin 27 is inserted through holes 18. An enlarged flange 27 on one end of pressure screw backup pin 27 limits the extent of insertion, and a keeper pin 27C (FIG. 5) inserted through hole 27B retains pressure screw backup pin 27 in holes 18.

Nut block 29 is inserted through retaining channel 23 so that threaded hole 30 is aligned with hole 22. Pressure screw 32 has a handle or knob 31 at its upper end, and a tapered, generally conical camming surface 33 at its lower end. Arrows 35 and 36 (FIG. 3) indicate directions of rotation of knob 31 to slow the rate of descending or stop the descender mechanism 14 and to increase the speed of descent, respectively.

Pressure screw 32 is threaded through hole 30 so that tapered end 33 extends between pressure screw backup pin 27, (which is stationary because of its engagement with holes 18) and pin 26, which is slidable in slots 17. Tightening of pressure screw 32 to nut block 29, forces the tapered camming surface 33 against both stationary backup pin 27 and pin 26, forcing pin 26 to slide to the upward, as shown in FIG. 5. Pin 25 also slides to the upward, equalizing the pressure on the portion of strap 13 between pins 25 and 26 and between pins 25 and 24. Nut block 29 moves to the upward as indicated by arrow 38 to maintain pressure screw 32 centered between pins 26 and 27.

In an initial prototype, the length of housing 16 is 2 15/16 inches long, $1\frac{1}{8}$ and 1 5/16 inches high. Nut block 29 is $\frac{3}{4}$ of an inch wide by $\frac{3}{8}$ of an inch thick. The walls of main channel 20 and nut block channel 23 can be composed of ordinary carbon steel or tempered aluminum metal which is one sixteenth of an inch or three thirty-seconds of an inch thick. The cylindrical pins preferably are composed of plain carbon steel and are 7/16 of an inch in diameter. Carbon steel handle 31 is approximately $1\frac{3}{4}$ inches in diameter. The diameter of carbon steel pressure screw 32 is $\frac{3}{8}$ of an inch. Nut block 29 can be of plain carbon steel. Its threads are standard machine threads, UNF (Unified National Fine) $\frac{3}{8}$ inch, 24 threads per inch. Camming surface 33 is $\frac{1}{4}$ of an inch in length in the direction of the longitudinal axis of pressure screw 32. Its diameter at its lower end is $\frac{1}{8}$ of an inch. Webbing strap 13 is 1 inch wide and 1/16 of an inch thick, and is composed of nylon. Harness straps 11H and 11I are 38 inches long. Seat web 11A of harness 11 is 16 inches from apex to base as shown in FIG. 2, the base being 20 inches wide. Strap 11G is 28 inches long, and straps 11E and 11F are 14 inches long.

A loop 37 is provided at the upper end of webbing strap 13 to facilitate attachment to a fixed object in the room from which the person needs to descend. Various other clamping or pinning devices could also be utilize to secure attachment of the upper end of webbing strap 13 to a stationary object.

I have constructed and tested a prototype device similar to the one described above. In one test, the pressure of tapered camming surface 33 applied tangentially to the pressure points of backup pin 27 and moveable pin 26 to provided excellent, smooth control of my weight (150 pounds) in the harness. Similar results were obtained in a test in which a 305 pound weight was suspended and another test in which a 364 pound weight was suspended.

The disclosed descender system, including a 40 foot length of 1 inch by 1/16 inch webbing strap (which occupies a volume of 30 cubic inches), the descender mechanism 14, and the harness, occupy a volume of only approximately 52 cubic inches, so the system can be easily carried in an ordinary suitcase.

The device described above has only four moving parts, namely pressure screw 32, nut block 29, and two sliding pins 25 and 26. This contributes to its reliability and potentially very low cost.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. A descender system comprising in combination:

(a) an elongated strap of sufficient length to lower a person from a danger area to a safe area, an upper end portion of the strap being adapted for attachment to a stationary object;

(b) a harness adapted to support the person;

(c) a compact destender mechanism having a channel through which the strap passes, the compact descender mechanism including (1) a connecting element securely connecting the harness to the compact descender mechanism;

(2) parallel, cylindrical first, second and third pins non-rotationally supported in side-by-side alignment in the channel, the strap passing through a first end of the channel around a portion of the first pin and between the first pin and the second pin, around a portion of the second pin and between the second pin and the third pin, and around a portion of the third pin, and through a second end of the channel;

(3) a support structure holding the first pin stationary in the compact descender mechanism and allowing movement of the second and third pins either toward or away from the first pin;

(4) a camming surface engaging a portion of a cylindrical surface of the third pin opposite to the second pin;

(5) a camming surface adjustment element adapted to move the camming surface in sliding, leveraged engagement with the third pin to force the third pin toward the second pin, increasing pressure of the first, second, and third pins on the strap, increasing frictional drag on the strap by the first, second, and third pins, and (6) a manual control element connected in leveraged relationship to the camming surface adjustment element to allow the person to adjust the speed of descent of the compact descender mechanism and harness.

2. The descender system of claim 1 wherein the camming surface adjustment element includes a threaded shaft perpendicular to a plane in which the first, second and third pins lie and engaging a threaded hole in a body of the compact descender mechanism, and wherein the camming surface is on a tapered end portion of the shaft.

3. The descender system of claim 2 including a fourth pin adjacent to the third pin and attached in fixed relationship to the compact descender mechanism, the camming surface extending between and engaging the cylindrical surfaces of the third and fourth pins.

4. The descender system of claim 3 including a moveable nut block through which the threaded hole and the threaded shaft extend, the fourth pin bearing against the tapered end as it is advanced between the third arid fourth pins, the nut block moving parallel to the plane according to the extent to which the tapered end is advanced between the third and fourth pins.

5. The descender system of claim 4 wherein the nut block is retained in a nut block channel in the compact descender mechanism.

6. The descender system of claim 5 wherein the manual control element includes a handle on an end of the threaded shaft opposite to the tapered end.

7. The descender system of claim 6 wherein the strap is composed of nylon.

8. The descender system of claim 7 wherein the channel includes opposed side walls having slots therein, the first, second and third pins having rectangular bosses at each end extending into and being slidable along the slots.

9. The descender system of claim 8 including a fifth pin adjacent to the fourth pin in the channel, the connecting element including a harness support strap separate from the elongated strap and looped around the fifth pin.

10. The descender system of claim 9 wherein the harness includes a seat web and a plurality of chords each connected at one end to the seat web and connected at an opposite end to a lower end of the harness support strap.

11. The descender system of claim 10 wherein the compact descender mechanism is 2 15/16 inches long, $1\frac{1}{8}$ inches wide, and 1 5/16 inches in height.

12. The descender system of claim 11 wherein a body of the descender mechanism is composed of carbon steel.

13. The descender system of claim 11 wherein the first, second, and third pins are imposed of tempered aluminum and are 7/16 inches in diameter.

14. The descender system of claim 11 wherein the strap is one inch wide and one sixteenth of an inch thick.

* * * * *